US007637045B2

(12) United States Patent
Sakai

(10) Patent No.: US 7,637,045 B2
(45) Date of Patent: Dec. 29, 2009

(54) SURFACE LIGHT SOURCE AND ELECTRICALLY ILLUMINATED SIGNBOARD

(75) Inventor: Yoshihiro Sakai, 2-27-32, Imakatata, Otsu-shi, Shiga (JP)

(73) Assignees: Asagicreate Co., Ltd., Kyoto (JP); Yoshihiro Sakai, Shiga (JP)

( * ) Notice: Subject to any disclaimer, the term of this patent is extended or adjusted under 35 U.S.C. 154(b) by 126 days.

(21) Appl. No.: 11/631,632

(22) PCT Filed: Jun. 29, 2005

(86) PCT No.: PCT/JP2005/011913

§ 371 (c)(1),
(2), (4) Date: Jan. 5, 2007

(87) PCT Pub. No.: WO2006/003913

PCT Pub. Date: Jan. 12, 2006

(65) Prior Publication Data

US 2008/0047181 A1 Feb. 28, 2008

(30) Foreign Application Priority Data

Jul. 6, 2004 (JP) ..... 2004-199526

(51) Int. Cl.

| | |
|---|---|
| ***G09F 13/04*** | (2006.01) |
| ***F21V 7/04*** | (2006.01) |
| ***F21V 21/00*** | (2006.01) |
| ***F21V 3/00*** | (2006.01) |
| ***F21V 5/00*** | (2006.01) |
| ***F21V 15/00*** | (2006.01) |

(52) U.S. Cl. ..... 40/564; 362/611; 362/612; 362/249; 362/227; 362/235; 362/249.02; 362/249.03; 362/249.11; 362/800; 362/311.02; 362/362; 362/367; 362/812

(58) Field of Classification Search ..... 40/564; 385/14; 362/611, 612, 249, 227, 235, 249.02, 362/249.03, 249.11, 800, 311.02, 362, 367, 362/812

See application file for complete search history.

(56) References Cited

U.S. PATENT DOCUMENTS 5,528,709 A 6/1996 Koike et al.

(Continued)

FOREIGN PATENT DOCUMENTS

JP 58-34175 3/1983

(Continued)

*Primary Examiner*—Lesley D Morris
*Assistant Examiner*—Syed A Islam
(74) *Attorney, Agent, or Firm*—Rabin & Berdo, PC

(57) ABSTRACT

There are provided a surface light source having uniform and high brightness independently whether the light source is small or large while using semiconductor light emitting devices (LEDs), and an electrically illuminated signboard using the surface light source, which is thin and capable of uniform display and which operates with low electricity consumption. LEDs (12) of a dome type are arranged on four corners at a bottom surface of a box body (11) of a tray shape whose bottom surface is quadrilateral, whose upper side is open, on an inner surface of which a light reflection member (11*b*) is provided, and whose side walls (11*c*) are inclined outward. The LEDs (12) are arranged so as to mainly irradiate a region between a vertical plane on a diagonal line (N) of the bottom surface and one side wall (11*c*), and the region irradiated by each of the LEDs (12) of the dome type arranged on the four corners rotates individually and sequentially in a specific direction (same direction) in the box body (11). One or more of the surface light source units are arranged to construct an electrically illuminated signboard.

12 Claims, 7 Drawing Sheets

U.S. PATENT DOCUMENTS

| | | | | |
|---|---|---|---|---|
| 5,819,454 | A * | 10/1998 | Rosenitsch | 40/452 |
| 6,964,507 | B2 * | 11/2005 | Mohacsi | 362/545 |
| 6,994,448 | B1 * | 2/2006 | Gorrell | 362/183 |
| 2002/0000057 | A1 * | 1/2002 | Nash | 40/564 |
| 2004/0093779 | A1 * | 5/2004 | Blach | 40/546 |
| 2005/0138852 | A1 * | 6/2005 | Yamauchi | 40/582 |
| 2005/0191464 | A1 | 9/2005 | Takahashi et al. | |

FOREIGN PATENT DOCUMENTS

| | | |
|---|---|---|
| JP | 58-146289 | 10/1983 |
| JP | 3-56978 | 5/1991 |
| JP | 6-15006 | 2/1994 |
| JP | 7-320514 | 12/1995 |
| JP | 2002-170402 | 6/2002 |
| JP | 2003-330394 | 11/2003 |
| JP | 2004-055229 | 2/2004 |
| JP | 2004-127680 | 4/2004 |
| JP | 2004-167820 | 6/2004 |

* cited by examiner

SURFACE LIGHT SOURCE AND ELECTRICALLY ILLUMINATED SIGNBOARD

FIELD OF THE INVENTION

The present invention relates to a surface light source used for illumination of electrically illuminated signboards, back lights of liquid crystal displays, or the like and relates to an electrically illuminated signboard using the same. More particularly, the present invention relates to a surface light source having high brightness and operating with reduced electric power consumption which can be used for illumination of electrically illuminated signboards, or the like, while using semiconductor light emitting devices (LEDs) as light sources, and relates to an electrically illuminated signboard using the same.

BACKGROUND OF THE INVENTION

Electrically illuminated signboards used for advertisement in stations or the like have a structure, as shown for example in FIG. 8, in which several straight fluorescent lamps (hereinafter referred to as fluorescent lamps) 101 or the like are arranged in a light reflection casing (housing) 102 so as to irradiate a display panel 104 or the like through a light diffusion plate 103 or directly. The housing is formed of, for example, stainless steel, aluminum or the like in a shape of a box having an opening at a top surface side, and the fluorescent lamps 101 or the like are provided therein. Then, the housing is formed by coating a light reflection material inside so that light from the fluorescent lamps irradiates the display panel 104 provided at a front side without being wasted (cf. for example PATENT DOCUMENT 1 (FIG. 9)).

On the other hand, as a surface light source using semiconductor light emitting devices (hereinafter referred to as LEDs, too), there has been introduced the surface light source irradiating light from the LEDs to a front side by introducing from a side face of a light guide plate and reflecting by a reflection plate provided at a back surface of the light guide plate or the surface light source formed by arranging LEDs, directly under the light diffusion plate, on the back surface of the light guide plate or without using the light guide plate (cf. for example PATENT DOCUMENT 1 (FIG. 7)).

PATENT DOCUMENT 1: Japanese Patent Application Laid-Open No. 2003-330394

DISCLOSURE OF THE INVENTION

Problem to be Solved by the Present Invention

Fluorescent lamps are generally employed for light sources in electrically illuminated signboards displayed occasionally in streets or the like, because high brightness and a large size are required. On the other hand, it has been expected to fabricate a surface light source for the electrically illuminated signboards by using semiconductor light emitting devices of low electric power consumption from an aspect of saving energy. In the surface light source which irradiates light from a surface of a light guide plate by introducing light of LEDs from a side surface of the light guide plate, uniform irradiation from an entire surface by diffusing light in the light guide plate is hardly obtained because light is apt to travel straight even if it is made easy to introduce light into the light guide plate by using LEDs of a dome type and by narrowing directionality of light. On the contrary, if the directionality is widened, light can not be taken into the light guide plate because total reflection increases due to increasing of oblique incident light to the side surface of the light guide plate. Therefore, light emitted from the LEDs can not be utilized efficiently, and there exists a problem that the surface light source of high brightness and uniformity can not be obtained.

Even if LEDs of a chip type are employed instead of the LEDs of the dome type, efficiency of introducing light into the light guide plate from the side surface is not sufficient. Moreover, although the surface light source of this type can be used for surface light sources for liquid crystal displays used in relatively small electric products, there exists a problem in a large surface light source for the electrically illuminated signboards or the like that the surface light source of uniform irradiation without joint portions in a surface of a wide area can not be obtained since enlargement by adding units can not be carried out because the LEDs are arranged on a side of the light guide plate.

Although it may be supposed that the LED chips instead of the LEDs of the dome type are arranged directly on a back side of a light diffusion plate, it is light near the LED chips but dark apart from the LED chips even if light from the LED chips is irradiated directly to the light diffusion plate without using the light guide plate. Since the LED chips should be arranged with an interval of, for example, approximately 20 mm and since a distance between the LED chips and the light diffusion plate should be 70 mm or more in order to light entirely with uniform brightness, then the surface light source of a thin type can not be obtained. Furthermore in the LED chips, as light is irradiated to all direction, a lot of light is irradiated crossways and effective light irradiated forward decreases, and then efficiency of using light decreases. As a result of this, there rises a problem that brightness can not be increased so much while a very large number of LED chips are necessary.

The present invention is directed to solve the above-described problems and an object of the present invention is to provide a surface light source of high brightness and uniformity, being free in size whether small type or large type, while using semiconductor light emitting devices (LEDs).

Another object of the present invention is to provide an electrically illuminated signboard with low electric power consumption, which is thin and which displays uniformly even in the electrically illuminated signboard displaying a large display panel.

Means for Solving the Problem

A surface light source unit according to the present invention includes a box body of a tray shape, whose bottom surface is quadrilateral, whose upper side is open, on an inner surface of which a light reflection member is provided, and whose side walls are inclined outward, and semiconductor light emitting devices of a dome type which are provided on at least opposite two corners of the bottom surface of the box body so as to mainly irradiate a region between a vertical plane on a diagonal line of the bottom surface and one side wall, the region being about a half space of the box body, wherein the semiconductor light emitting devices provided on at least two corners of the bottom surface of the box body are arranged in places of rotational symmetry as to a center of the box body and the region irradiated by each of the light emitting devices moves in a manner of the rotational symmetry.

Here, the semiconductor light emitting device of the dome type means a semiconductor light emitting device so called a bullet type or a lamp type having a structure in which a chip of a semiconductor light emitting device is bonded in a curved recess and molded with light transmitting resin so as to have a predetermined directionality characteristics by making the surrounding in a shape having a dome shape on its top and by being accompanied with a shape of the curved recess. The manner of the rotational symmetry means, although, in case that the quadrilateral is a square, the LEDs are arranged at places of the rotational symmetry as to a center, in case that the quadrilateral is not a square, LEDs are arranged on corners of the quadrilateral so as to irradiate light to a half region equally even though the corners are not perfectly symmetric.

A light diffusion member may be provided on a surface of an opening surface side of the box body. In addition, two light emitting devices may be arranged on each corner of at least the two corners, and wherein a set of the two light emitting devices are arranged so that each region mainly irradiated by the two light emitting devices is a different half space as to a diagonal line passing the corner where the two light emitting devices are provided.

A surface light source according to the present invention includes: a plurality of surface light source units provided side-by-side, and a light diffusion member on or over the plurality of surface light source units so as to cover the plurality of surface light source units, wherein each of the plurality of surface light source units comprising; a box body of a tray shape, whose bottom surface is quadrilateral, whose upper side is open, on an inner surface of which a light reflection member is provided, and whose side walls are inclined outward, and semiconductor light emitting devices of a dome type which are provided on at least opposite two corners of the bottom surface of the box body so as to mainly irradiate a region between a vertical plane on a diagonal line of the bottom surface and one side wall, the region being about a half space of the box body.

The plurality of surface light source units are arranged side-by-side so as to prevent adjacent two side walls of adjacent two surface light source units from being exposed in the same height at a surface, by forming a side wall of one surface light source unit lower than the other at a place of adjoining each other. By this structure, a uniform and large surface light source which has unnoticeable joint portions can be obtained even if a large surface light source is formed by arranging the plurality of surface light source units side-by-side.

It is preferable in order to make joint portions more unnoticeable that a light reflection sheet is stuck on an inner surface of the lower side wall of the one surface light source unit so as to overhang from a top end surface of the other side wall, thereby to cover the top end surface of the other side wall.

An electrically illuminated signboard according to the present invention includes: a surface light source formed with one or more surface light source units, a light diffusion plate provided through a certain distance over the surface light source and a display panel provided on the light diffusion plate, wherein each of the one or more surface light source units includes; a box body of a tray shape, whose bottom surface is quadrilateral, whose upper side is open, on an inner surface of which a light reflection member is provided, and whose side walls are inclined outward, and semiconductor light emitting devices of a dome type which are provided on at least opposite two corners of the bottom surface of the box body so as to mainly irradiate a region between a vertical plane on a diagonal line of the bottom surface and one side wall, the region being about a half space of the box body.

By a structure in which the surface light source unit is fixed by fixing a bottom surface of the surface light source unit to a fixing metal part provided on a bottom surface of a casing through a circuit board, wiring semiconductor light emitting devices becomes simple and maintenance becomes easy.

Effect of the Invention

By the present invention, since semiconductor light emitting devices (LEDS) of a dome type are provided on at least opposite two corners of the bottom surface of the box body of a tray shape, on an inner surface of which a light reflection member is provided, so as to mainly irradiate a region between a vertical plane on a diagonal line of the bottom surface and one side wall, and so as to be arranged in positions and directions of rotational symmetry on at least two corners, direction of irradiation by each of the light emitting devices moves in a manner of the rotational symmetry, too. Therefore, in light irradiated from the LED of a dome type, light traveling forward is reflected by a side wall opposite to the LED and returns into the box body, and light spread from a center of the LED is reflected by the bottom surface of the box body or one of the side walls, as a result, light travels toward the opening surface side and is irradiated from an opening surface side. Moreover, as LEDS provided on at least two corners are arranged so that a direction of irradiation rotates, if LEDs are arranged on four corners, a quarter area formed by dividing with diagonal lines at the opening surface of a quadrilateral box body is irradiated by two LEDs, and whole light irradiated from the LED is used and irradiated from an entire surface uniformly.

In other words, in case of introducing light of an LED from a side of a light guide plate, when directionality is widened, useless light increases because light irradiated obliquely from the LED is reflected and is not introduced into the light guide plate, and when light is made not travel too obliquely, the light is not diffused uniformly in the light guide plate. And, in case of irradiating directly from a down side of a light diffusion plate, as the directionality is strong, a large distance to the light diffusion plate is necessary to make a uniform light source and as the large distance makes the electrically illuminated signboard thick, there occurs not only inconvenience such as decreasing of brightness at a display panel, but also increasing of useless light. Therefore, light of LEDs can not be used effectively and the surface light source for the electrically illuminated signboard in which high brightness is required, has not been obtained yet.

By the present invention, since, while utilizing directionality of LEDs, whole of the light is irradiated from the opening surface side efficiently and the light is diffused uniformly in the box body, a surface light source of very high brightness and thin type can be obtained. And as the box body has no projecting part outside because the LEDs are provided in the box body, the surface light source of a predetermined size can be obtained by arranging a predetermined number of box bodies in directions of length and width. As a result, an electrically illuminated signboard with low electric power consumption, a long life time and maintenance free can be obtained by using semiconductor light emitting devices, even if it is a large type.

In case of fabricating the surface light source of a predetermined size by arranging the plurality of surface light source units, each unit of which is composed of one box body, as a width of an area from which no light is irradiated can be prevented from increasing by two thickness of adjacent side walls of the box bodies by forming a side wall of one surface light source unit lower than the other at a place of adjoining each other, the surface light source of a large type and high uniformity can be obtained in which a joint portion is unnoticeable even if the surface light source of the large type is formed by arranging the plurality of surface light source units side-by-side. Further, the joint portion is made more unnoticeable by sticking a light reflection sheet on an inner surface of the lower side wall of the one surface light source unit so as to overhang from a top end surface of the other side wall, thereby to cover the top end surface of the other side wall.

EXPLANATION OF LETTERS AND NUMERALS

Figure 1A:
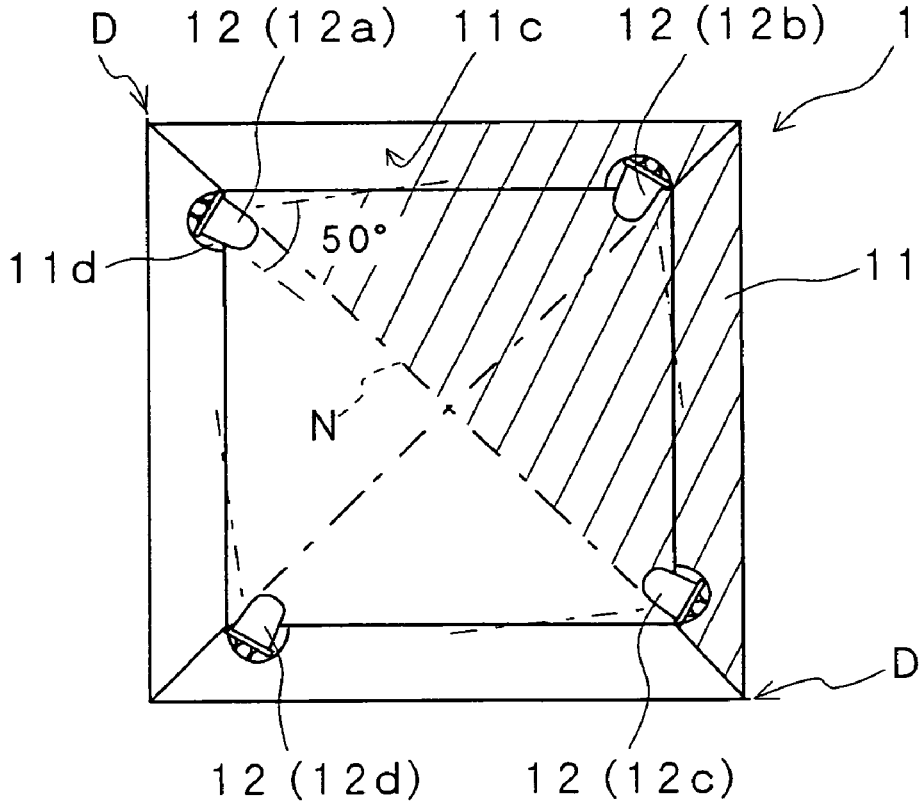
FIGS. 1A to 1C are figures explaining a plan view and a partially broken side view of an embodiment of the surface light source unit according to the present invention, and a cross-sectional view of the box body.

1: surface light source unit
2: casing
3: light diffusion plate
4: display panel
5: transparent sheet
11: box body
11*a*: aluminum plate
11*b*: light reflection member
11*c*: side wall
11*d*: through hole
11*e*: rivet hole
11*f*: light reflection sheet
12: LED
13: light diffusion member

THE BEST EMBODIMENT OF THE PRESENT INVENTION

Figure 1B:
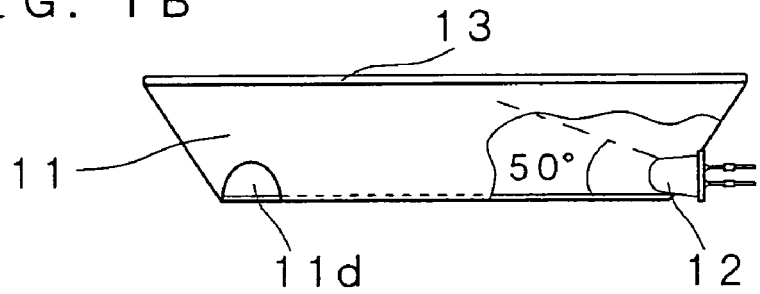
Figure 1C:
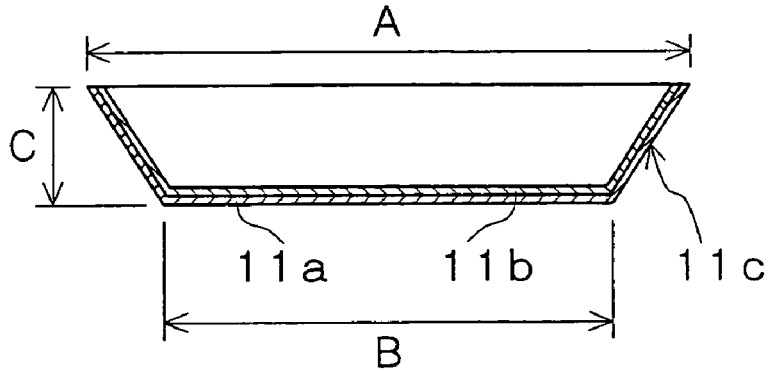

An explanation will be given below of a surface light source and an electrically illuminated signboard using the same according to the present invention in reference to the drawings. As there are shown in FIGS. 1A to 1C, figures explaining a plan view and a partially broken side view of an embodiment of the surface light source unit according to the present invention, and a cross-sectional view of the box body, the surface light source unit according to the present invention is provided with LEDs 12 of a dome type provided on at least opposite two corners of the bottom surface of the box body 11 of a tray shape, whose bottom surface is quadrilateral, whose upper side is open, on an inner surface of which a light reflection member 11*b* is provided, and whose side walls 11*c* are inclined outward. In an example shown in FIG. 1A, one of the LEDs 12 is provided on each of four corners of the box body. The LEDs 12 are arranged so as to mainly irradiate a region (a hatched part as a region irradiated by one LED 12*a* in FIG. 1A) between a vertical plane on a diagonal line N of the bottom surface and one of the side walls 11*c*, and so that regions irradiated by the LEDs 12 (12*a* to 12*d*) arranged on the four corners rotate in order in a certain direction (same direction) in the box body 11.

In an example shown in FIG. 1B, a light diffusion member 13 such as a light diffusion sheet, an adjusting film of diffusion angle and a control film of view angle, are provided at an opening surface side of the box body 11. By arranging the light diffusion member of this kind, as light can be irradiated uniformly from a surface of the light diffusion member 13, a uniform surface light source can be obtained with only a thickness of the box body and a thin surface light source can be obtained. But in stead of providing the light diffusion member 13, almost uniform brightness can be obtained in a surface, by keeping a distance approximately 10 mm or more and although a thickness increases a little, the surface light source of high brightness can be obtained without decaying of light by the light diffusion member.

Figure 2A:
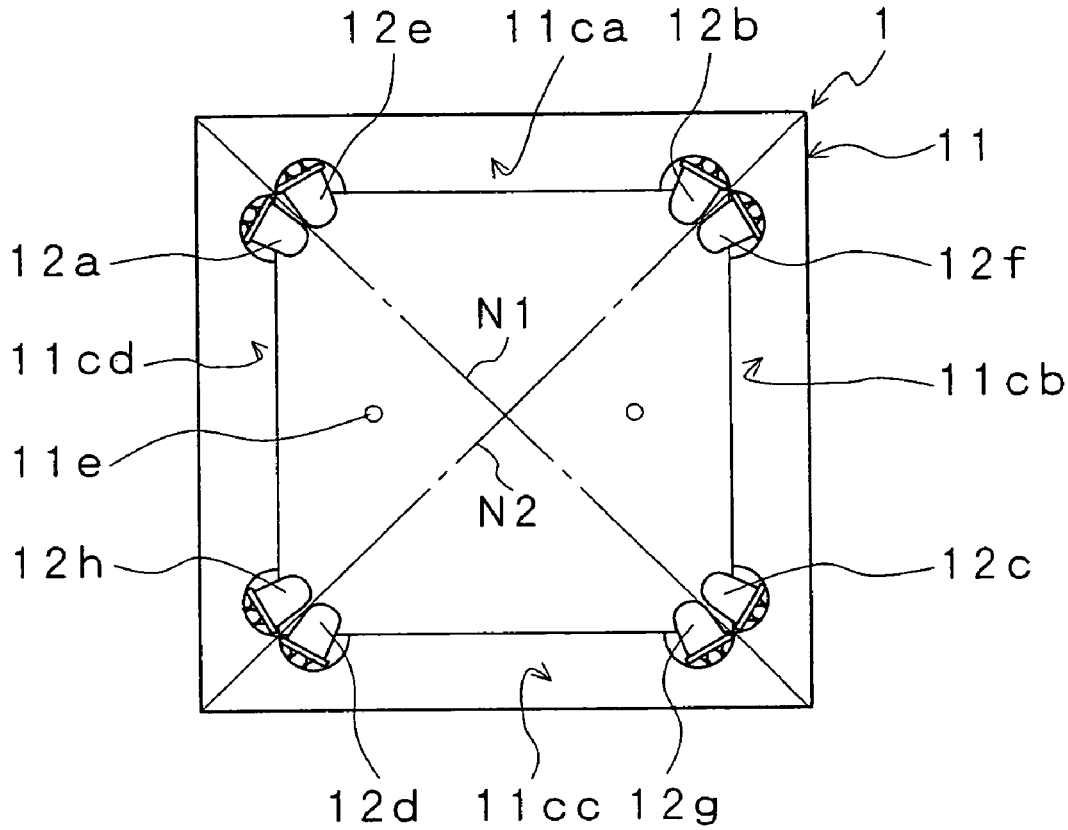
FIGS. 2A and 2B are figures explaining plan views of an example of other constitutions of the surface light source unit and of a box body before assembling.
Figure 2B:
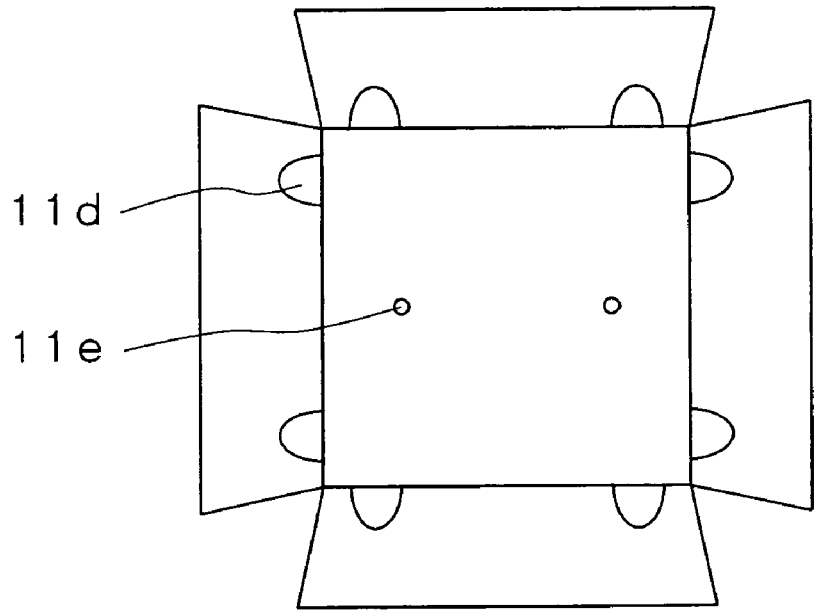

For example, as shown in FIG. 1C, the box body is formed by sticking a reflection member 11*b* such as, for example, the product E60 (foamed sheet of polyester of approximately 180 μm thick) by Toray Co., Ltd on one surface of an aluminum plate 11*a* approximately 0.35 mm thick, by punching it in a shape shown in FIG. 2B described later, and by bending parts of an end surface side into a tray shape. A height of the side wall 11*c* to be bent and a bending angle is decided so that light is reflected efficiently and irradiated from the opening surface side effectively. For example, in case that a side A of an outer circumference is 80 mm (square shape, same hereinafter), a side B of the bottom surface is approximately 54.4 mm and a height C is approximately 14.2 mm and in case that a side A of an outer circumference is 100 mm, a side B of the bottom surface is approximately 74.4 mm and a height C is approximately 19.2 mm. As the reflection member 11*b* is a foamed sheet having irregularity on its surface, it becomes a random reflection surface reflecting light in all direction. As the reflection member 11*b*, the product MCPET (ultra fine foamed light reflection sheet) of approximately 1 to 2 mm thick by Furukawa Electric Co., Ltd, or the like can be employed.

As for the side walls 11*c* of the box body 11, when the surface light source unit is used alone, the four walls 11*c* may have a same height, but when a large surface light source is fabricated by arranging the plurality of surface light source units, heights of two walls are preferably lower than those of others to prevent two top end surfaces of the side walls from adjoining each other at a joint portion. In FIG. 1A, as the heights of the side walls 11*c* of an upper side and a right side are formed lower, level differences are formed at parts represented by D. In addition, in order to the joint portion more unnoticeable, by sticking a light reflection sheet such as the light reflection member 11*b* on an inside surface of one of side walls highly, a dead space of the joint portion observed from front side becomes approximately 0.18 mm of a thickness of the sheet, and the joint portion becomes more unnoticeable. These details will be explained in FIG. 7B.

Through holes 11*d* in which LEDs 12 described later are inserted are formed at corners of the side walls 11*c* of the box body 11 so that only dome parts of the LEDs 12 are inserted in the box body 11, and that lead parts are connected with circuit boards or the like outside of the box body 11.

Powder of titanium oxide or the like is coated on a surface of the light reflection member 11*b* of the box body 11, and as the powder irradiated by ultraviolet rays emitted from LEDs or the like has a function of a catalyst to dissolve and eliminate organic contaminants on the surface of the light reflection member 11*b* without deteriorating light reflection coefficient, contamination by dust or the like can be inhibited. As a result, in addition to using semiconductor light emitting devices of a very long life time as light sources, maintenance free during a long period can be achieved without deteriorating brightness.

As the LEDs 12, a white LED is used which is formed by mounting an LED chip in a concavity formed at an end of a lead, and by molding surroundings with light transmitting resin in an dome shape, and which has a characteristics of directionality of approximately 40 to 60 degrees, more preferably approximately 45 to 60, (example of 50 degrees is shown in FIG. 1). A reason why the LED of a dome type having such characteristics of directionality is used will be explained below.

In order to diffuse light irradiated from the LEDS 12 in the box body 11 usefully and uniformly and to irradiate the light through the light diffusion member 13 to a front side uniformly, by the present invention, one LED 12*a* of LEDs arranged on the four corners of the bottom surface, by the present invention, is arranged so as to mainly irradiate a region (a hatched part as a region irradiated by one LED 12*a* in FIG. 1A) between a vertical plane on a diagonal line N of the bottom surface and one of the side walls 11*c*, and so that regions irradiated by LEDs 12 (12*a* to 12*d*) arranged on the four corners rotate in order in a certain direction (same direction) in the box body 11. Therefore, the LEDs 12 are arranged not toward a center of the box body 11 but inclined to one side wall 11*c*.

Here, the leads of the LEDs are outside of the box body 11 and only molded parts with resin are in the box body 11. As the directionality of the LEDs 12 is a stereo type, light spreads not only in a direction parallel to a paper of the figure but also in a direction perpendicular to the paper, light spread to the bottom surface side of the box body 11 is reflected at the bottom surface of the box body 11, and most part of light spread opposite to the bottom surface is irradiated upward as it is, or in case that the light diffusion member 13 is arranged at upper surface, when light, whose incident angle to the light reflection member 13 is an angle of total reflection, is irradiated from the surface of the light diffusion member 13 by reflection in the box body 11 after the total reflection, and light not reflected totally is irradiated directly upward.

As a result, the LEDs 12 are arranged so that the one LED 12*a* takes charge of irradiating mainly a half region of the space of the box body 11, that the adjacent LED 12*b* takes charge of irradiating a half region between a diagonal line rotated 90 degrees and the adjacent side wall 11*c*, and that the LED 12*c* and 12*d* take charge of irradiating a half region rotated successively. Then, a quarter region surrounded by vertical planes on two diagonal lines in the box body 11 and the side wall 11*c* is irradiated by mixed light from two LEDs. Strictly speaking, light from other LEDS are also mixed by repetition of diffused reflection in the box body 11, but ratios are nearly same in any regions.

Thereby, as the one of the LEDS 12 takes charge of irradiating a half region divided by a vertical plane on the diagonal line in the box body 11, LEDs having a directionality characteristics of 40 to 60 degrees, preferably 45 to 60 degrees are used to irradiate the region by light from the LEDs 12. By this structure, since the box body can be bright around its corners, because brightness of light at an edge part of the irradiated region (outer region of a 60 degrees side of the directionality characteristics) is comparatively high, and since light at a center of the irradiated region is diffused in the box body 11 by reflecting at the side wall 11*c*, brightness in the box body is easily to be made uniform. Therefore, although the directionality characteristics described above is used, even if an angle of the directionality characteristics is too large, there occurs no problem because light irradiated from three or more of the LEDs 12 is mixed. Though, concentrated and bright light can be irradiated toward a front side when using LEDs of a dome type by diffused reflection at the light reflection member 12 in the box body 11, but efficiency of using light decrease remarkably when using LED chips arranged directly, because light can not be reflected strongly at the light reflection member, and because the light is absorbed by adjacent LED chips.

In addition, by this constitution, since a quarter region of the space of the box body 11 is irradiated by light mixed of light from mainly two LEDs, even if brightness or color is different among the LEDs 12, brightness or color of light is made uniform by mixing light, while using light of each of the LEDs 12 effectively. Especially, in case of white LEDs, depending on LEDs, some are bluish or yellowish white, or there is a case that brightness varies widely, but even in such case, colors and brightness are uniformed by mixing light irradiated from at least two LEDs.

Although, in the example shown in FIG. 1, each one of the LEDS 12 is arranged on each corner of the four corners of the box body 11, it is preferable to arrange each two of the LEDs 12 on each corner of the four corners, because brightness can be enhanced further and because uniformity is easily obtained even if variance of color or brightness exists among the LEDs, 12. The example is shown in FIG. 2A. In FIG. 2B, an example of a punched plate formed by sticking the above-described aluminum plate and the reflection member to make a box body for this type is shown, and through holes 11*d* for inserting the LEDs 12 are formed in this punching process. The box body 11 is formed by bending side parts of the punched plate. Here, 11*e* represents rivet holes to fix the light source unit 1 with a push rivet in a structure described later.

In other words, in FIG. 2A, it is in a same manner as that of the example described above that the LED 12*a* irradiates the region between the vertical plane on the diagonal line N1 and one side wall 11*ca*, that the LED 12*b* irradiates the region between the vertical plane on the diagonal line N2 and one side wall 11*cb*, that the LED 12*c* irradiates the region between the vertical plane on the diagonal line N1 and one side wall 11*cc*, and that the LED 12*d* irradiates the region between the vertical plane on the diagonal line N2 and one side wall 11*cd*. The LEDs added on each corner are arranged so that the LED 12*e* irradiates the region between the vertical plane on the diagonal line N1 and one side wall 11*cd*, that the LED 12*h* irradiates the region between the vertical plane on the diagonal line N2 and one side wall 11*cc*, that the LED 12*g* irradiates the region between the vertical plane on the diagonal line N1 and one side wall 11*cb*, and that the LED 12*f* irradiates the region between the vertical plane on the diagonal line N2 and one side wall 11*ca*; and are arranged so as to irradiate regions different from that irradiated by the four LEDs of a first group overlapping a half region of an inverse direction.

Figure 3A:
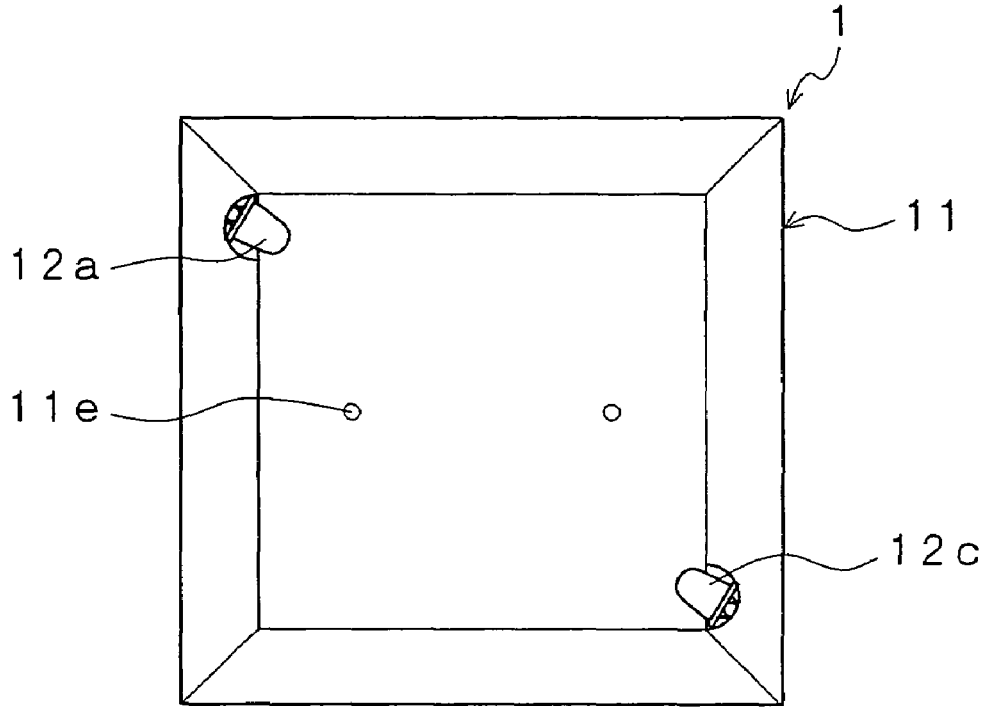
FIGS. 3A and 3B are figures showing still other examples of the surface light source unit according to the present invention.
Figure 3B:
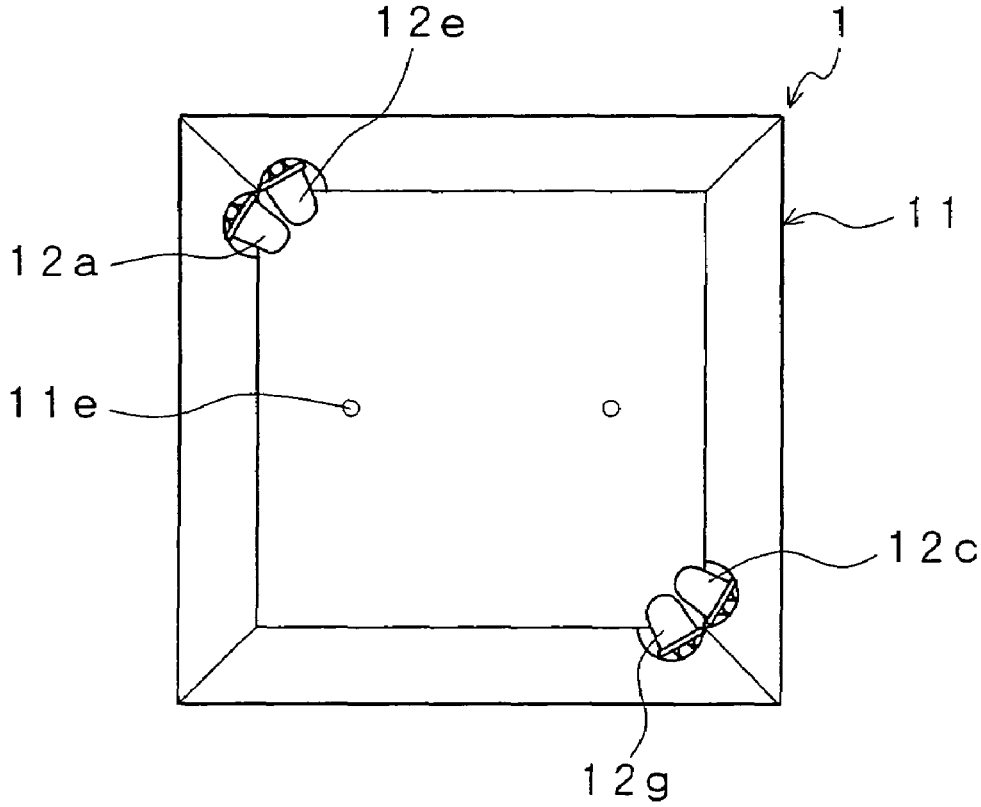

In each of the examples described above, one or two of the LEDs 12 are arranged on each of the four corners of the box body 11, and also, in place of arranging on the four corners, by arranging the LEDs 12 having the directionality described above in the direction described above even on two corners opposite to each other along a diagonal line, one of the LEDs 12 can cover a half region divided by the diagonal line of the box body 11 as described above, and nearly uniform light can be irradiated from the opening surface side of the box body 11. Examples of this type are shown in FIGS. 3A and 3B. FIG. 3A shows a constitution which is composed of two LEDs of the LED 12*a* and 12*c* shown in the example of FIG. 1A, and FIG. 3B shows a constitution which is composed of the LEDs 12*a*, 12*e* and the LEDs 12*c*, 12*g* shown in an example of FIG. 2. Even in such arrangement, whole space of the box body 11 is irradiated and the surface light source irradiating uniform light from an entire surface can be obtained.

In the example shown in FIG. 1, a light diffusion member 13 is provided on the opening surface side of the box body 11 of a tray shape. As the light diffusion member 13, a material having high light transmissivity and property of diffusing light, made of for example polycarbonate or the like such as light diffusion sheet provided on a surface of a light guide plate for a backlight in a liquid crystal display used for book-type personal computers is preferable because loss of light is small and because light of high brightness and uniformity can be irradiated. But, a usual light diffusion plate called "semi-transparent milky-white" can be used. When the light diffusion member 13 is provided, decreasing of light is not a small even if a material of high light transmissivity is used and the material of higher light transmissivity is more expensive. Then, when a distance to a display panel or the like provided over the box body 11 can be kept 10 mm or more, the light diffusion member 13 may not be used, because brightness is uniformed by providing the space.

In the surface light source unit 1 according to the present invention, as described above, the LEDs 12 of a dome type are arranged on at least two corners of the box body 11 of a tray shape, on an inner surface of which a reflection member 11*b* is provided, and arranged so that a region irradiated by the LEDs 12 rotates a half space of the box body 11 sequentially. Therefore, light irradiated from the LEDS 12 can be irradiated from a surface of the light diffusion member 13 or the opening surface of the box body 11 without any waste by reflecting light diffusedly in the box body 11. Here, in case of forming the surface light source of 80 mm square by using four of the LEDs 12 of 0.057 W input power, brightness at a front surface even provided with a light diffusion member 13 is approximately 400 cd, and in case of forming the surface light source of 100 mm by using the same LEDs, the brightness is approximately 300 cd. Furthermore, in case of forming the light source of 100 mm square by using the LEDs 12 of 1 W input power, brightness is high and approximately 2000 cd. A size of the box body 11 can be arranged depending on a desired brightness or output power of LEDs. In addition, by operating the LEDs 12 with a pulse driving or an alternating current driving, lifetime of the LEDs 12 is elongated and electric power consumption is reduced because brightness can not be influenced by irradiation by afterimages while the LEDs 12 do not emit light.

Further, in the surface light source according to the present invention, as the LEDs do not stick out of the box body because the LEDs are arranged in the box body, the surface light source units of a desired number can be arranged in directions of length and width, and the surface light source of a desired size can be obtained. Although wiring to supply electricity to the LEDs is necessary, as the box body is a tray shape having a bottom surface of smaller area than that of the opening surface side, spaces are formed at the bottom side when the surface light source units are arranged and wiring can be set in the spaces. Therefore, the surface light source units can be arranged without any dead space in the irradiation surface. In addition, as described later, leads of the LEDs 12 can be easily connected to the wiring by fixing the box body 11 on a circuit substrate, and by forming wiring on the circuit board in the space to be formed by arranging the box bodies 11 of a tray shape (trapezoidal).

Figure 4A:
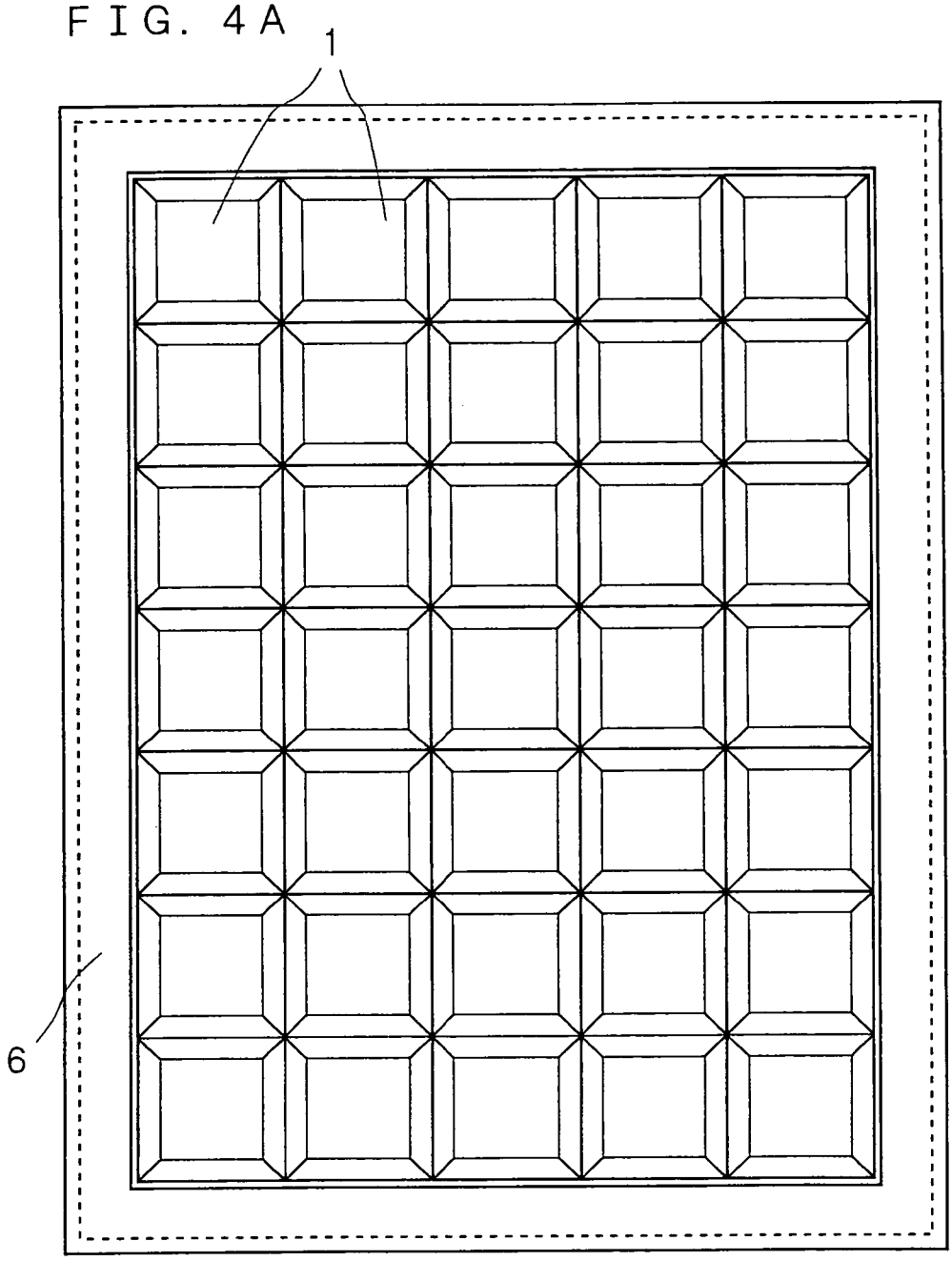
FIGS. 4A and 4B are figures explaining a plan view and a cross-sectional view of an electrically illuminated signboard formed by using the surface light source units shown in FIG. 1.
Figure 4B:
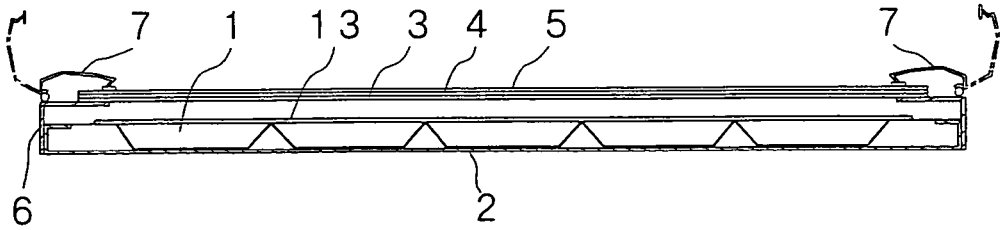

An example of the large surface light source and the electrically illuminated signboard, by arranging a plurality of surface light sources, will be explained below. In FIGS. 4A and 4B, a plan view of a state removing a display panel and a light diffusion plate, and cross-sectional view of the electrically illuminated signboard are shown respectively.

As shown in FIGS. 4A and 4B, a light source of an electrically illuminated signboard is formed as the surface light source formed by arranging surface light source units 1 shown in FIGS. 1A to 1C in directions of length and width in a casing or case 2 formed of, for example, an aluminum plate or the like. The surface light source units 1 are fixed to a fixing metal part 21, in a shape having no top part of a triangle in a cross-sectional view, provided on a bottom surface of the casing 2 by welding or the like with push rivets 22 made of resin. By fixing with such push rivets 22 or the like, if it becomes necessary to exchange LEDs because of faults occurring in the LEDs 12 or the like, exchange of the surface light sources 1 can be easy as the surface light sources 1 can be easily removed while fixing the surface light sources not to move. When the above-described light diffusion member 13 is provided in case of the plurality of surface light source units 1 arranged, it is preferable that the light diffusion member 13 is not provided to each of the surface light source units 1, but provided so as to cover the plurality of surface light source units 1 arranged by one light diffusion plate 3, from the aspect of making joint lines unnoticeable and reducing a production cost comparing with providing to each of the surface light sources.

Figure 5:
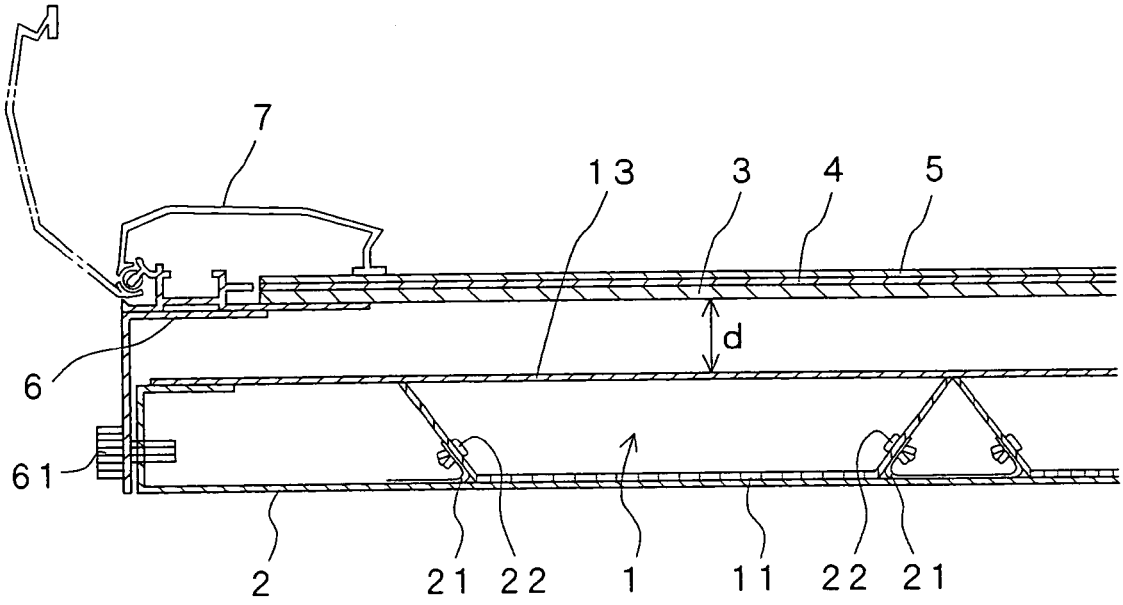
FIG. 5 is an enlarged figure of a part of FIG. 4B.
Figure 6:
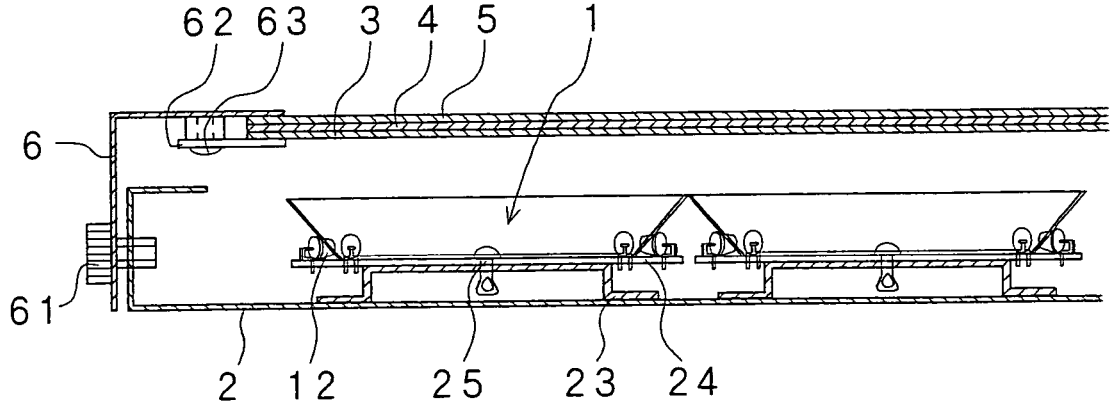
FIG. 6 is a partially enlarged cross-sectional view explaining an example of other constitutions of the electrically illuminated signboard according to the present invention.

A fixing structure of the surface light source unit 1 is not limited to the structure described above, the surface light source may be fixed by a structure shown in FIG. 6 showing an enlarged cross-sectional view of a part of the electrically illuminated signboard like that in FIG. 5. Namely, the structure shown in FIG. 6 is a structure in which by fixing a fixing metal part 23 to a bottom of the casing 2 by welding or the like, a circuit board 24 and the surface light source unit 1 are fixed together to the fixing metal part 23 with the push rivets 25. In this fixing step, the above-described rivet holes 11*e* shown in FIG. 3 are used. By this structure, by providing necessary resistors or wirings on the circuit board 24, the LEDs 12 can be connected easily to a power source only by fixing the surface light source unit 1 with the push rivets 25 and by connecting leads of the LEDs 12, And, by making a size of the circuit board 24 a little smaller than that of an outer shape of a front side of the surface light source unit 1, a little space (approximately 2 mm) may be formed between adjacent circuit boards 24, assembling is easy performed even if there is a little displacement in an assembly step.

In case of making a large surface light source by arranging the surface light source units 1, joint portion of the units are made unnoticeable by providing a light diffusion member 13 to cover the plurality of box bodies 1 by one light diffusion member, but the joint portion may be noticeable somewhat especially in case of providing no light diffusion member 13. As described above, the box body 11 is formed with a material formed by sticking a light reflection member 11*b* approximately 0.18 mm thick on a surface of an aluminum plate 11*a* approximately 0.35 thick, and by bending edge parts. Therefore, a thickness is approximately 0.53 in total and an edge surface thereof may be exposed to an upper surface as a result of bending. As the light reflection member 11*b* are exposed on an entire inner surface of the box body 11 except the through holes 11*d* to be inserted by the LEDs 12, reflected light by diffused reflection is observed as irradiation from the entire inner surface, but light of diffused reflection can not be observed on the edge surface because light from the LEDs can not reach the edge surface. The edge surface not irradiating light of diffused reflection may be observed as dark line when the width becomes over approximately 1 mm of two times by arranging two surface light source units 1.

Figure 7A:
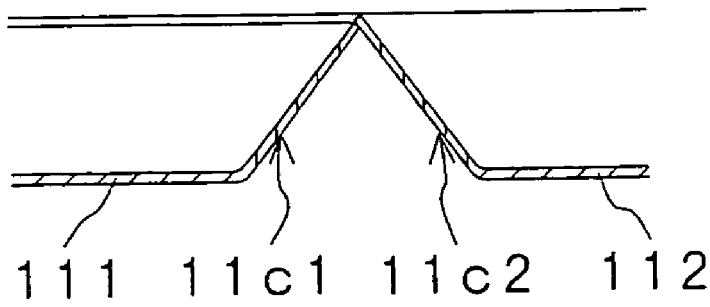
FIGS. 7A to 7C are figures explaining an example eliminating lines of joint portions in case of arranging surface light source units.

As shown for example in FIG. 7A, since a thickness of an edge surface of a joint portion can be reduced to approximately 0.5 mm of a thickness of one side wall by forming a height of one side wall 11*c*1 of an adjacent box body 111 lower than a height of a side wall 11*c*2 of another box body 112 as a means to solve a problem described above, only one side wall 11*c*2 of a side wall not irradiating diffused light is exposed, and then, the joint portion can be almost unnoticeable by using the light diffusion member 13 or by making a distance to a display panel provided at an upper side large. Then, as shown in FIG. 4A, in case of arranging the surface light source units 1 in directions of length and width, by forming heights of two of four side walls of a quadrilateral lower than those of other two side walls as shown in FIG. 1A, a large surface light source in which joint portions of the box bodies are not unnoticeable can be obtained by arranging so as to adjoin side walls of a high height and a low height, when the surface light source units 1 are arranged side-by-side.

Figure 7B:
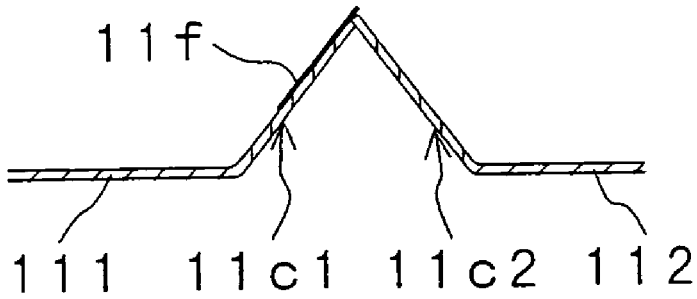
Figure 7C:
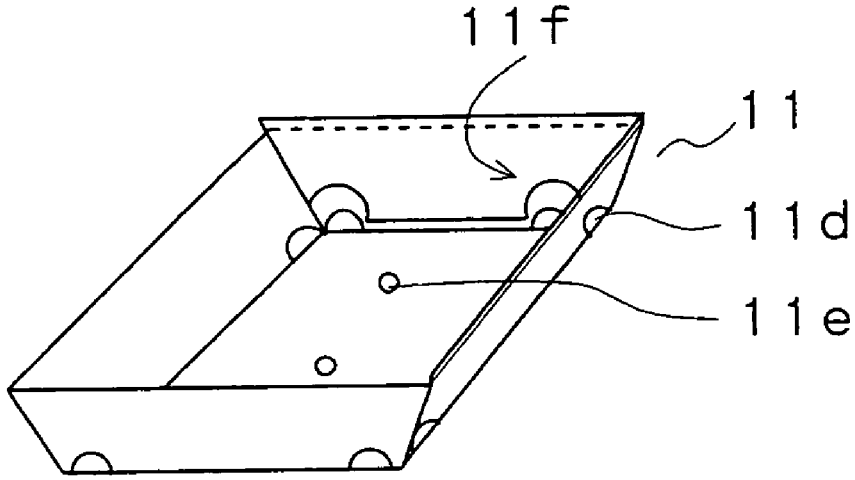
Figure 8:
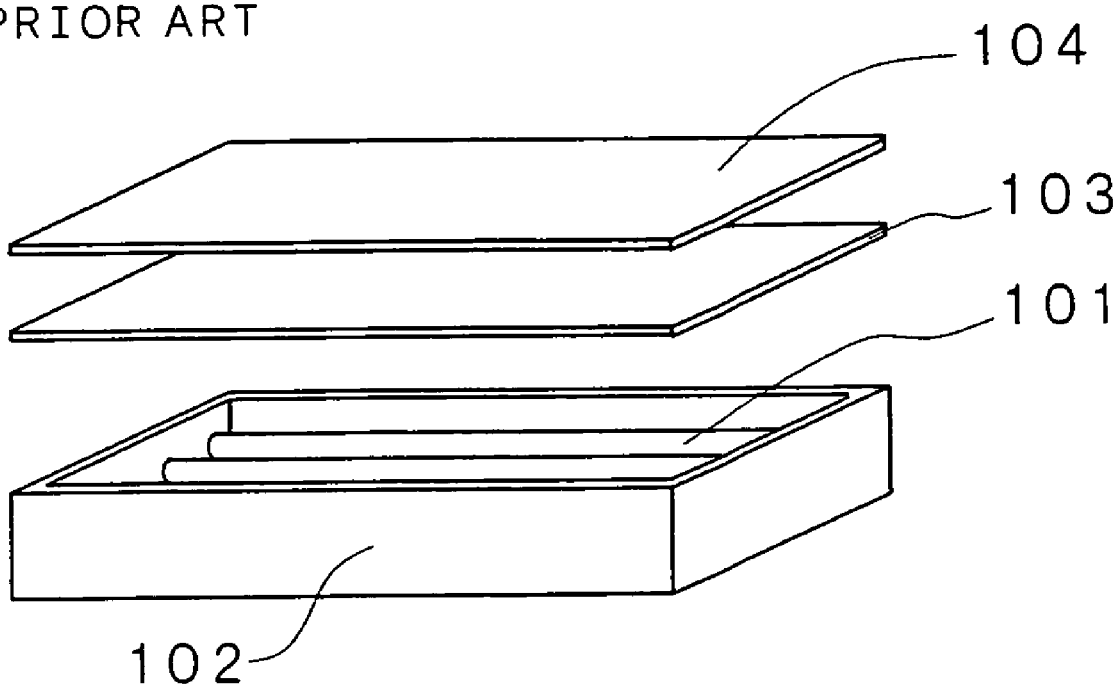
FIG. 8 PRIOR ART
FIG. 8 is a figure explaining an example of constitutions of an electrically illuminated signboard by the prior art.

An example in which the joint portions are made more unnoticeable is shown in FIGS. 7B and 7C. Namely, as a figure of a similar explanatory cross-sectional view to FIG. 7A is shown in FIG. 7B, a light reflection sheet 11*f* such as the light reflection member 11*b* is stuck on an inner surface of the side wall 11*c*1 of a slightly lower height so as to cover the edge surface of the side wall 11*c*2 of the box body 112, the side wall 11*c*2 being provided so as to hang over the side wall 11l of the box body 111. As a result, the light reflection sheet 11*f* is approximately 0.18 mm thick, approximately same as the reflection member 11*b*, an edge part of the side wall 11*c*2 can be almost unnoticeable by viewing from a front side because of being hided by the light reflection sheet 11*f*. As described above, as the light reflection sheet 11*f* is only stuck on two side walls of the box body 11, as a figure of an explanatory oblique view of one box body 11 in FIG. 7C, the light reflection sheets 11*f* are stuck on two side walls so as to be slightly higher than other side walls. In addition, when the light reflection sheet 11*f* is stuck on an inner surface of the side wall 11*c*2 of a higher height, an edge surface of the side wall 11*c*2 can be made also unnoticeable by viewing from a front side.

An electrically illuminated signboard by using the surface light source is fabricated, in a same constitution as usual: by providing a light diffusion plate 3 apart from the surface of the light diffusion member 13 of the surface light source with a distance d (cf. FIG. 5) of approximately 5 to 10 mm (approximately 10 to 25 mm in case of not providing the light diffusion member 13); by providing a display panel 4 on which images are painted; by superposing a transparent cover 5; and by fixing with fixing metal parts 7 provided on a lid body 6. The lid body 6 formed of aluminum plate like a casing 2 and fixed to the casing 2 with screws 61 holds the light diffusion plate 3, the display panel 4 or the like through a certain distance from the light diffusion member 13 at a periphery. In an example shown in FIG. 4B, the fixing metal part 7 is a lever type to make fixing and taking away easy, and in FIGS. 4B and 5, a state of taking away of the fixing metal part 7 is represented with dashed dotted lines. By this structure, it becomes easy to exchange the display panel 4 and to repair the surface light source 1.

As shown in FIG. 6, there may be employed a structure in which the lid body 6 may be fixed to the casing 2 by fixing the light diffusion plate 3, the display panel 4 and the transparent cover 5 to the lid body 6 with a fixing plate 62 and screws 63, in place of providing the fixing metal part 7 described above. By this structure, extra projecting parts are reduced and a thickness of the electrically illuminated signboard can be thin in total.

The light diffusion plate 3 is a plate of a thickness of approximately 3 mm made of milky white acrylic resin (PMMA) usually called "semi-transparent milky-white", polyethylene terephthalate (PET), polycarbonate, glass or the like and has a function of irradiating light from even an oblique direction uniformly to all direction on its surface. Although the light diffusion plate 3 is preferably thick for making light from an oblique direction of an under surface not having directionality, a light diffusion sheet such as thin vinyl sheet (FF sheet) or milky white sheet can be used as a light diffusion plate when variance of light irradiated from the light diffusion member 13 of the under surface is hardly observed.

The display panel 4 is a transparent sheet on which images to be displayed such as letters, figures or the like are printed in color, and it is irradiated from back side by lighting to display brightly. A transparent cover 5 in a film form or of a thickness of several millimeters made of acrylic plate or glass plate is superposed in order to protect the display panel 4 at a top surface side of the display panel 4.

By this structure, for fabricating an electrically illuminated signboard of an A2 size of 57 cm (length)×41 cm (width), in case of arranging one LED on each corner described above, when the surface light source unit 1 of 10 cm square is used, surface light sources of 6 units×4 units=24 units (electric power consumption of 5.5 W in total LED) are used and when a surface light source unit 1 of 8 cm square is used, a surface light source of 7 units×5 units=35 units (electric power consumption of 8 W in total LED) are used, and electrically illuminated signboards are obtained whose brightness at each display surface are approximately 300 cd and approximately 400 cd. In a case of arranging two LEDs on each corner of the surface light source unit 1 for high brightness use, when an electrically illuminated signboard of a A2 size is fabricated, brightness of approximately 600 cd at electric power consumption of 11 W is obtained by using the surface light source unit of 10 cm square, and brightness of approximately 800 cd at electric power consumption of 16 W is obtained by using the surface light source unit 1 of 8 cm square (extra high brightness). In a conventional electrically illuminated signboard using fluorescent lamps, two fluorescent lamps of 20 W are needed to get a signboard of an A2 size and of brightness of approximately 600 cd, then same brightness can be obtained with electric power consumption of approximately a quarter or less comparing to the conventional electric power consumption.

This comes from that light is used effectively without being wasted because a distance between a light source and a display panel can be very small by using LEDs having directionality and by irradiating strong light obtained by diffused reflection from a shallow box body by diffusing uniformly by using reflection in the box body. In addition, as the distance between the light source and the display panel can be very small, a signboard can be constituted with a total thickness (distance from a bottom surface of the casing 2 to the top face) of approximately 54 mm even in case of providing the fixing metal part shown in FIG. 4B and of approximately 45 mm in case of not using the fixing metal part and but fixing with a planar surface.

INDUSTRIAL APPLICABILITY

The surface light source according to the present invention can be used for backlight of liquid crystal displays or electrically illuminated signboards used in stations, public squares, exhibition places or the like.

What is claimed is:

1. A surface light source, comprising:

a plurality of surface light source units arranged side-by-side; and a single light diffusion member covering the plurality of surface light source units, wherein each surface light source unit of the plurality of surface light source units comprises:

a box body having a tray shape, a bottom surface that is quadrilateral, an upper side that is open, side walls that are inclined outward, an inner surface, and four corners;

a light reflection member provided on the inner surface of the box body;

a circuit board that is provided at the lower part of the bottom surface of respective box bodies and that has a size that is smaller than the external size of an opening end portion of the respective box bodies and larger than the bottom surface of the respective box bodies;

through-holes formed in each corner of the four corners of the box body at lower parts of the side walls; and four dome-type semiconductor light emitting devices that are each inserted into respective through-holes, that each have a dome part positioned within the box body, that each have a lead part positioned outside the box body and inside the outer shape of the opening end portion of the box body and connected with the circuit board, that each have directionality characteristics of irradiation ranging from 45 to 60 degrees, and that each mainly irradiate a region of the box body (a) that is a half space, (b) that is a rotationally symmetrical space between a vertical plane on a diagonal line of the bottom surface of the box body and the side walls, and (c) that is overlappingly irradiated by two dome-type semiconductor light emitting devices of the four dome-type semiconductor light emitting devices, so that the four dome-type semiconductor light emitting devices cooperate to irradiate the space within the box body with mixed light, wherein the plurality of surface light source units are arranged without the circuit boards of the adjacent surface light source units touching each other and with the opening end portions of the box bodies of the adjacent surface light source units being brought into close contact with each other.

2. The surface light source according to claim 1, wherein a plurality of surface light source units are arranged side-by-side so as to prevent adjacent two side walls of adjacent two surface light source units from being exposed in the same height at a surface, by forming a side wall of one of the adjacent two surface light source units lower than a side wall of the other of the adjacent two surface light source units in a height of the side wall at an opening end portion of the box body at a place where the adjacent two surface light source nits are joined.

3. The surface light source according to claim 2, wherein the light reflection member is a sheet attached on an inner surface of the lower side wall of one surface light source unit so as to overhang from a top end surface of an adjacent side wall, thereby to cover the top end surface of the adjacent side wall.

4. An electrically illuminated signboard, comprising:

a plurality of surface light sources according to claim 1 arranged side-by-side;

one light diffusion plate arranged so as to cover the plurality of surface light source units and positioned a certain distance over the plurality of surface light sources, and a display panel provided on the light diffusion plate.

5. The electrically illuminated signboard according to claim 4, wherein a plurality of surface light source units are arranged side-by-side so as to prevent adjacent two side walls of adjacent surface light source units from being exposed in the same height at a surface, by forming a side wall of one of the adjacent two surface light source units lower than a side wall of the other of the adjacent two surface light source units in a height of the side wall at an opening end portion of the box body at a place where the adjacent two surface light source nits are joined.

6. The electrically illuminated signboard according to claim 5, wherein the light reflection member is a sheet attached on an inner surface of the lower side wall of one surface light source unit so as to overhang from a top end surface of an adjacent side wall, thereby to cover the top end surface of the adjacent side wall.

7. The surface light source according to claim 1, wherein each dome-type semiconductor light emitting device of the four dome-type semiconductor light emitting devices is a set of two dome-type semiconductor light emitting devices arranged so that each region mainly irradiated by the two dome-type semiconductor light emitting devices is a different half space with respect to a diagonal line that passes through the corner where the two light emitting devices are provided, so that the eight dome-type semiconductor light emitting devices cooperate to irradiate the space within the box body with mixed light.

8. An electrically illuminated signboard, comprising:

a case having an opening;

at least one surface light source according to claim 1, arranged within the case;

a light diffusion plate covering the plurality of surface light source units; and a display panel covering the light diffusion plate, wherein the light diffusion plate and the display panel are provided in the opening of the case spaced apart from the surface of the at least one surface light source by a certain distance.

9. The electrically illuminated sign board according to claim 8, wherein each surface light source unit of the plurality of surface light source units further comprises holes formed in the circuit hoard and the surface light source unit, and a fixing metal part for fixing together the circuit board and the surface light source unit to the case at a bottom surface thereof.

10. A surface light source, comprising:

a plurality of surface light source units arranged side-by-side; and a single light diffusion member covering the plurality of surface light source units, wherein each surface light source unit of the plurality of surface light source units comprises:

a box body having a tray shape, a bottom surface that is quadrilateral, an upper side that is open, side walls that are inclined outward, an inner surface, and four corners;

a light reflection member provided on the inner surface of the box body;

a circuit hoard that is provided at the lower part of the bottom surface of respective box bodies and that has a size that is smaller than the external size of an opening end portion of the respective box bodies and larger than the bottom surface of the respective box bodies;

through-holes formed in each corner of the four corners at lower parts of the side walls of the box body; and eight dome-type semiconductor light emitting devices that are each inserted into respective through-holes, that each have a dome part positioned within the box body, that each have a lead part positioned outside the box body and inside the outer shape of the opening end portion of the box body and connected with the circuit board, that each have directionality characteristics of irradiation ranging from 45 to 60 degrees, and that each mainly irradiate a region of the box body (a) that is a half space, (b) that is a rotationally symmetrical space between a vertical plane on a diagonal line of the bottom surface of the box body and the side walls, and (c) that is overlapping irradiated by four dome-type semiconductor light emitting devices of the eight dome-type semiconductor light emitting devices, so that the eight dome-type semiconductor light emitting devices cooperate to irradiate the space within the body box with mixed light, wherein the plurality of surface light source units are arranged without the circuit boards of the adjacent surface light source units touching each other and with the opening end portions of the box bodies of the adjacent surface light source units being brought into close contact with each other.

11. An electrically illuminated signboard, comprising:

a case having an opening;

at least one surface light source according to claim 10, arranged within the case;

a light diffusion plate covering the plurality of surface light source units; and a display panel covering the light diffusion plate, wherein the light diffusion plate and the display panel are provided in the opening of the case spaced apart from the surface of the at least one surface light source by a certain distance.

12. The electrically illuminated sign board according to claim 11, wherein each surface light source unit of the plurality of surface light source units further comprises holes formed in the circuit board and the surface light source unit, and a fixing metal part for fixing together the circuit board and the surface light source unit to the case at a bottom surface thereof.

* * * * *